US005332185A

United States Patent [19]

Walker, III

[11] Patent Number: 5,332,185

[45] Date of Patent: Jul. 26, 1994

[54] GUN REST

[76] Inventor: Fred M. Walker, III, P.O. Box 791456, San Antonio, Tex. 78279

[21] Appl. No.: 71,757

[22] Filed: Jun. 8, 1993

[51] Int. Cl.[5] ..... A47B 91/00

[52] U.S. Cl. ..... 248/346; 42/94; 248/910

[58] Field of Search ..... 248/346, 102, 105, 910, 248/1; 42/94

[56] References Cited

U.S. PATENT DOCUMENTS

| | | | |
|---|---|---|---|
| 172,039 | 11/1876 | Lazarevitch . | |
| D. 312,650 | 12/1990 | Charrier . | |
| D. 324,530 | 3/1992 | Blaylock . | |
| 1,089,279 | 3/1914 | Simer et al. . | |
| 2,134,746 | 11/1938 | Allen | 248/102 |
| 2,356,602 | 8/1944 | Madsen . | |
| 2,507,939 | 5/1950 | Smith . | |
| 2,510,953 | 6/1950 | Brose | 248/102 |
| 2,522,120 | 9/1950 | Kaskey | 248/102 |
| 2,566,838 | 9/1951 | Hurt . | |
| 2,616,467 | 11/1952 | Cicero . | |
| 2,669,272 | 2/1954 | Permann et al. . | |
| 2,693,837 | 11/1954 | Klein . | |
| 3,012,350 | 12/1961 | Wold . | |
| 3,125,145 | 3/1964 | Williams . | |
| 3,137,419 | 6/1964 | Davy . | |
| 3,144,197 | 8/1964 | Milner et al. . | |
| 3,361,265 | 1/1968 | Wernimont . | |
| 3,367,380 | 2/1968 | Dickey . | |
| 3,537,628 | 11/1970 | Thompson . | |
| 3,726,329 | 4/1973 | Dean . | |
| 3,772,813 | 11/1973 | Sands . | |
| 3,863,882 | 2/1975 | Hatcher . | |
| 3,935,657 | 2/1975 | Wade | 42/94 |
| 3,941,245 | 3/1976 | Oliverius . | |
| 3,947,988 | 4/1976 | Besaw | 42/94 |
| 4,055,017 | 10/1977 | Thompson . | |
| 4,065,171 | 12/1977 | Nagy . | |
| 4,153,089 | 5/1979 | Veilleux . | |
| 4,162,696 | 7/1979 | Sprung . | |
| 4,192,329 | 3/1980 | Swearingen . | |
| 4,195,880 | 4/1980 | Henkhaus . | |
| 4,501,401 | 2/1985 | Conee | 248/1 |
| 4,558,531 | 12/1985 | Kilby . | |
| 4,558,532 | 12/1985 | Wright . | |
| 4,691,371 | 9/1987 | Derby . | |
| 4,707,873 | 11/1987 | A-Yan . | |
| 4,758,099 | 7/1988 | Branson . | |
| 4,790,096 | 12/1988 | Gibson | 42/94 |
| 4,821,443 | 4/1989 | Bianco . | |
| 4,873,777 | 10/1989 | Southard . | |
| 4,895,327 | 1/1990 | Malone | 248/102 |
| 4,937,881 | 7/1990 | Heise . | |
| 5,050,330 | 9/1991 | Pilgrim et al. . | |
| 5,050,713 | 9/1991 | Lee . | |
| 5,056,932 | 10/1991 | Young . | |
| 5,058,302 | 10/1991 | Minneman . | |
| 5,172,980 | 12/1992 | Provost . | |
| 5,199,602 | 4/1993 | Drew . | |
| 5,233,779 | 8/1993 | Shaw | 42/94 |

FOREIGN PATENT DOCUMENTS

| | | |
|---|---|---|
| 7409548 | 2/1975 | Netherlands . |

*Primary Examiner*—J. Franklin Foss
*Attorney, Agent, or Firm*—Charles W. Hanor

[57] ABSTRACT

A gun rest comprising a central compartment of a shape which allows the barrel of a gun to be conveniently supported, and one or more attached compartments utilized to stabilize and support the central compartment. The compartments are intended to be filled with a substance such as sand, and incorporate closures comprising an inverted spout, one side of which is made from the hook part of a hook and loop fastener, and the other side of which is the loop part of a hook and loop fastener. A closure such as a spout and pocket closure may also be used.

3 Claims, 3 Drawing Sheets

GUN REST

BACKGROUND OF THE INVENTION

The present invention relates generally to the field of rifle rests and is particularly useful in providing a stable support for the barrel of a firearm such as a rifle or shotgun in marksmanship or hunting. The device is fabricated from suede leather and/or fabric combinations and consists or two or more compartments filled with sand or similar material which are stitched together to form the whole. The use of sand bags as gun rests and as elements of gun rests is well known in the prior art. Known U.S. Patents relating to the use of sand bag gun rests include: 3,947,988; 4,501,401; 4,790,096; 5,050,330; and Des. 312,650. The current invention incorporates a recessed upper surface integral to the compartment upon which the gun is rested. The current invention also incorporates a closure technique used for sealing the sand or similar material within the device. Known U.S. Patents relating to closure devices for bags include: 2,507,939; 2,566,838; and 4,691,371.

The unique configuration and construction of this gun rest permits its use from almost any firing position, such as prone from the ground, out the window or port of a hunting blind, from a fence rail or from the tailgate of a truck bed.

One object of the present invention is to provide a stable gun rest.

Another object of the present invention is to provide an extremely portable gun rest.

A third object of the present invention is to provide a gun rest which is readily adjustable for use in situations in which it is necessary to use the gun rest on a variety of surfaces such as a variety of types of deer blinds, etc.

Another object of the present invention is to provide a gun rest which can be quickly repositioned.

Another object of the present invention is to provide a gun rest which can be collapsed into a very small volume for transporting and storage.

Yet another object of the present invention is to provide a gun rest which can cradle the barrel of a gun in a variety of angles and positions without the need for elaborate adjustments.

Other objects of the invention will be apparent from the specification and claims to one skilled in the art.

SUMMARY OF THE INVENTION

A gun rest comprising a central compartment of a shape which includes a recess for receiving the barrel of a gun to be conveniently supported thereon, and two attached compartments utilized to stabilize and secure the central compartment in place on a support. The compartments are intended to be filled with a dense substance such as sand, and incorporate closures comprising an inverted spout, one side of which is made from the hook part of a hook and loop fastening, and the other side of which is the loop part of a hook and loop fastening. Other closures, such as a spout and pocket closure, may also be used.

DESCRIPTION OF THE PREFERRED EMBODIMENT

Figure 1:
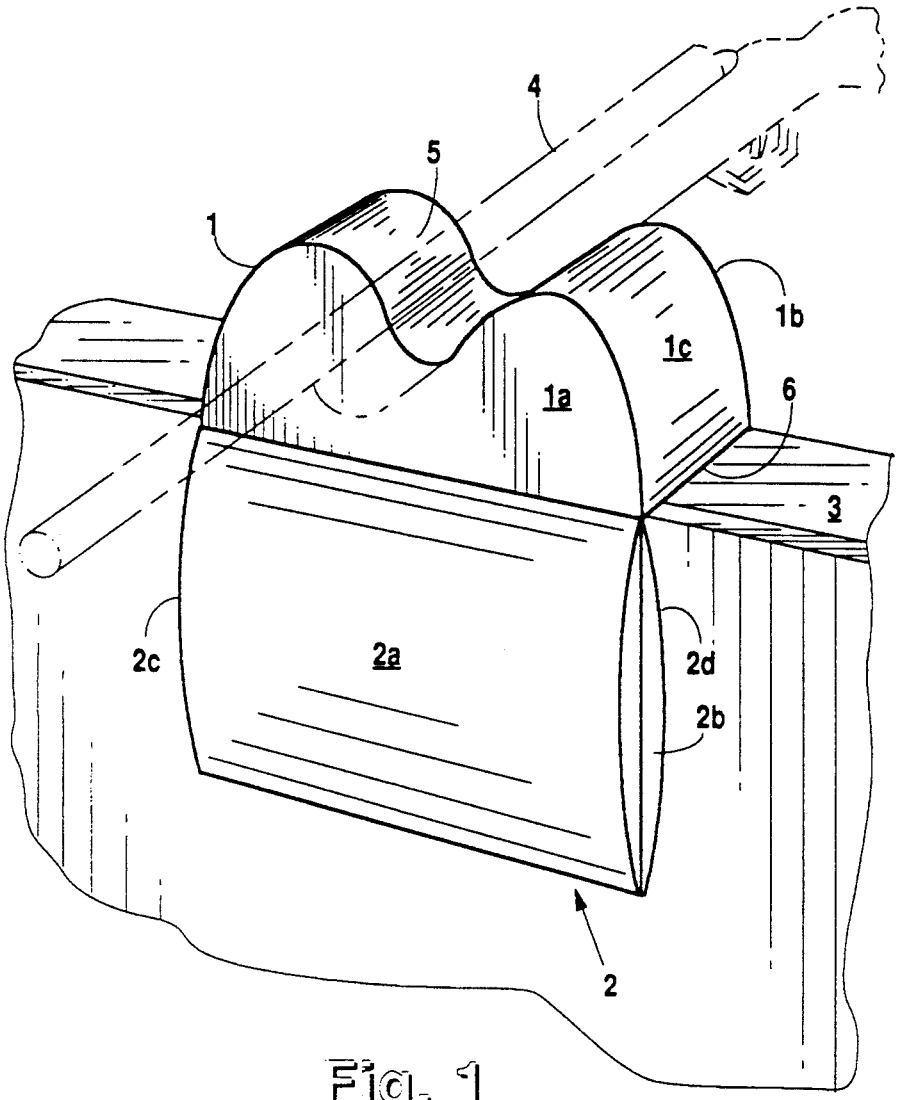
FIG. 1 shows an embodiment of the invention positioned in the window of a deer blind and indicating the position of a gun.

The preferred embodiment depicted in FIG. 1 comprises a central compartment 1 made of suede or similar material which includes a front side 1*a*, rear side 1*b*, and top member 1*c*; a front stabilizing compartment 2 also made of suede or similar material, which includes an outer side 2*a*, inner side 2*d*, and left and right members 2*b* and 2*c*. In use, the gun rest is placed over a window jamb 3 in such a fashion that the inner side 2*b* of the front stabilizing compartment frictionally adjoins the outer surface of a window jamb 3 and the outer surface of wall 3*a*; and the under surface 6 of the central compartment 1 frictionally adjoins the top surface of window jamb 3, thereby allowing the gun rest to be used to steady a gun such as a rifle 4 that is placed in recess 5 in the top member 1*c* of the central compartment 1.

Central compartment 1 is held in place by friction between its bottom surface 6 and window jamb 3 and is stabilized in part by the weight of sand in front stabilizing compartment 2 and the friction between the inner surface 2*d* of front stabilizing compartment 2 and the window jamb 3 and wall 3*a*.

Figure 2:
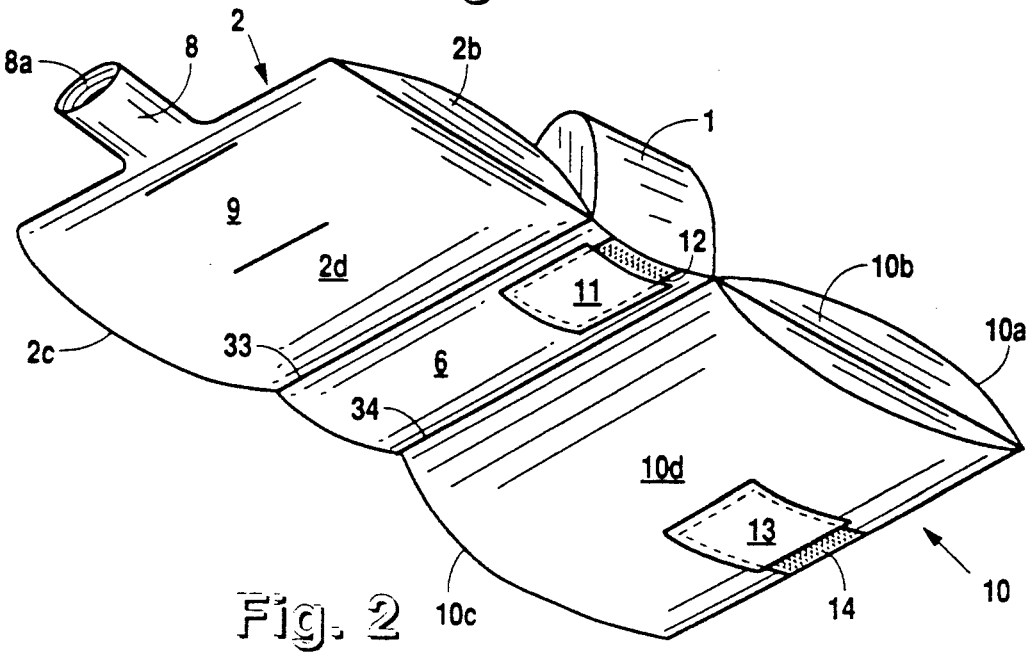
FIG. 2 is an embodiment of the invention with the side compartments spread to show the underside of the invention.

FIG. 2 shows the preferred embodiment spread open to reveal the underside 7. Shown in FIG. 2 is the second stabilizing compartment 10 which is symmetrically placed to the rear of central compartment 1 and which counter-balances front stabilizing compartment 2. Stabilizing compartment 10 includes an inner side 10*d*, an outer side 10*a*, and left and right members 10*b* and 10*c*. In use, the inner side 10*d* of stabilizing compartment 10 frictionally adjoins window jamb 3 and the rear side of wall 3*a*. Also shown in FIG. 2 is one possible way to effect closure of the compartments after they are filled with sand. Spout 8, having an opening 8*a*, is used with a funnel or similar device to fill front stabilizing compartment 2 with sand. Once the compartment is filled and tamped, spout 8 is pressed flat and folded over and tucked into pocket 9 where it is held securely and forms an effective seal for the compartment 2. A similar spout 13 and pocket 14, on rear stabilizing compartment 10, are shown in the closed position.

The central compartment 1 also has such a spout 11 and pocket 12 for use in filling the central compartment 1. The dimension of central compartment 1 from front to back is approximately two and one-half inches, so that when full of sand or similar material it will fit the window jamb of a typical deer blind. The gun rest may be adjusted in size so that it engages the window jamb of an arbitrary deer blind by adjusting the amount of sand in central compartment 1 and stabilizing compartments 2 and 10. The gun rest can be filled to effectively engage wider or narrower window jambs or other surfaces such as tree limbs, car doors, truck tail gates, fence rails or even flat surfaces such as rocks or the ground.

As can further be seen in FIG. 2, connecting seam 33 between central compartment 1 and front compartment 2, and connecting seam 34 between central compartment 1 and rear compartment 10 act as hinges. In use, connecting seams 33 and 34 extend slightly downward from the gun rest and so also help to provide an ability for the gun rest to grip the support on which it is placed.

Figure 3:
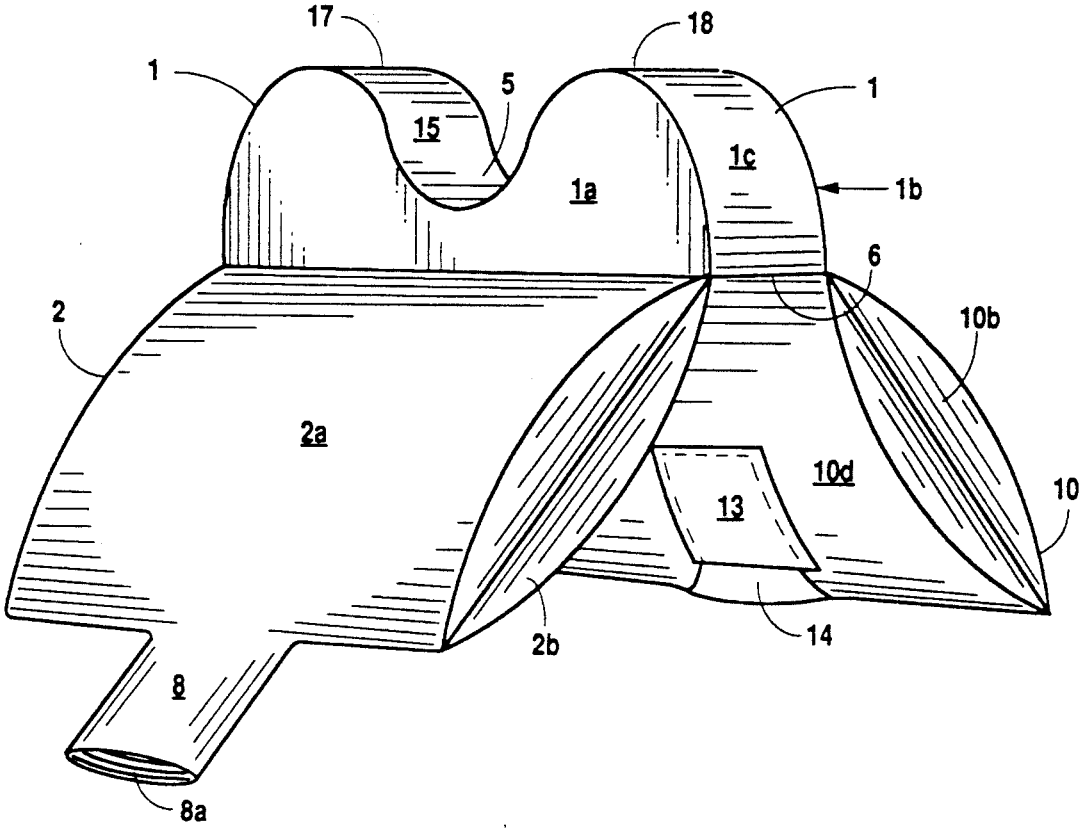
FIG. 3 depicts an embodiment of the invention with an alternative closure consisting of a spout and pocket.

FIG. 3 is an isometric view of the preferred embodiment. The central compartment 1 is approximately six inches wide from side to side, approximately two and one-half inches from front to back, and approximately three inches at its highest point. Its bottom surface 6 is approximately flat. The top surface comprises a pair of humps 17 and 18 forming the recess or valley 5 approximately one and one-half inches from the top of the humps to the bottom of the recess or valley. In use, a gun is positioned in the recess 5 either perpendicularly to the central compartment 1 or at an angle. Because the central compartment 1 is filled with sand and is made of a flexible material, it will conform itself to the position of the gun so that the gun may be aimed at an angle to the central compartment without loss of stability.

As can be seen by one skilled in the art, the frictional characteristics of the bottom surface of the central compartment 6 allow the use of the gun rest on supports which are not completely horizontal, particularly since when used in such a fashion, the gun can be rested on what is otherwise slope 15 of the hump of the center compartment 1.

Figure 4:
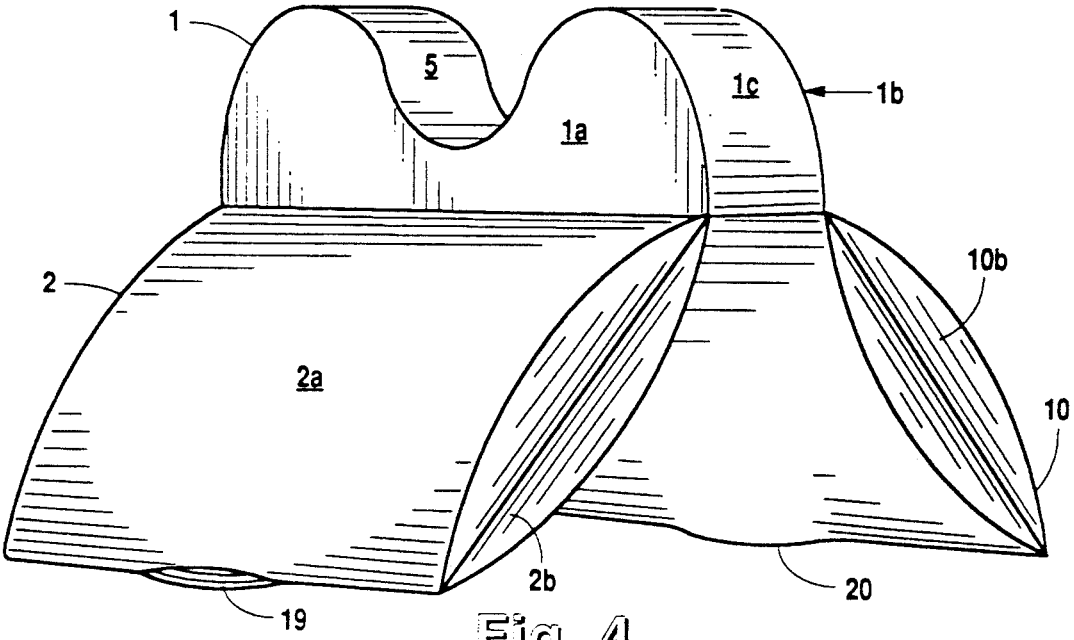
FIG. 4 depicts an embodiment of the invention utilizing the internal hook and loop spout closure.

FIG. 4 shows a preferred embodiment of the invention has many common components with the embodiment of FIGS. 1–3. It differs in that it utilizes a closure 19 consisting of an internal spout of hook and loop material on the front compartment 2, which is shown closed in FIG. 4. A similar closure 20 is used on the rear compartment 10. Similarly, the closure of the central compartment 1 is of the internal spout type.

Figure 5:
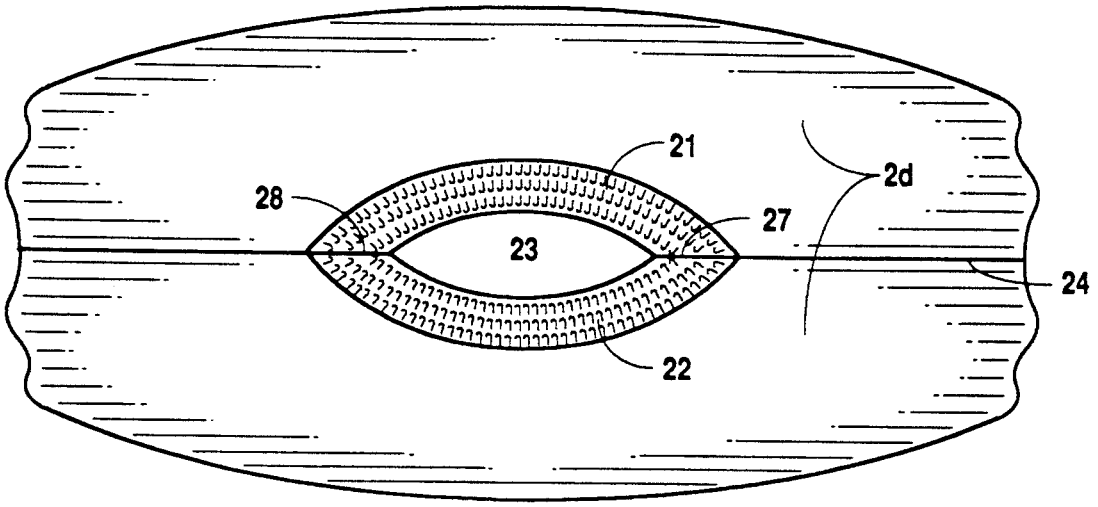
FIG. 5 shows in more detail the internal hook and loop spout closure.

The internal spout closure is shown in more detail in FIG. 5. A hook surface 21 is fastened to the upper surface 2*a* of the compartment, and a loop surface 22 is fastened to the lower surface 2*d* of the compartment, at seam 24, between upper surface 2*a* and lower surface 2*d*. In FIG. 5, the closure is shown partly opened so that the interior of the bag containing sand 23 can be seen. The closure is constructed by fastening a tab of hook material 21 at the edge of the piece of suede or other material which will eventually become upper surface 2*a* and by similarly attaching a tab of loop material 22 to the piece of suede or other material which will eventually become lower surface 2*d* and securing the edges of the tabs to each other at 27 and 28. The hook and loop tabs are then juxtaposed, hook to loop, and are fastened together, whereupon the piece of material 2*a* is stitched to the piece of material 2*d* at all points along seam 24, except where the tabs of hook and loop material, 21 and 22, respectively, are attached. The tabs of hook and loop material are stitched together along edges 27 and 28, but the forward and rear edges of the tabs are left unstitched. The partly constructed compartment is then inverted, so that the tabs of hook and loop material form an inverted spout internal to the compartment.

Figure 6:
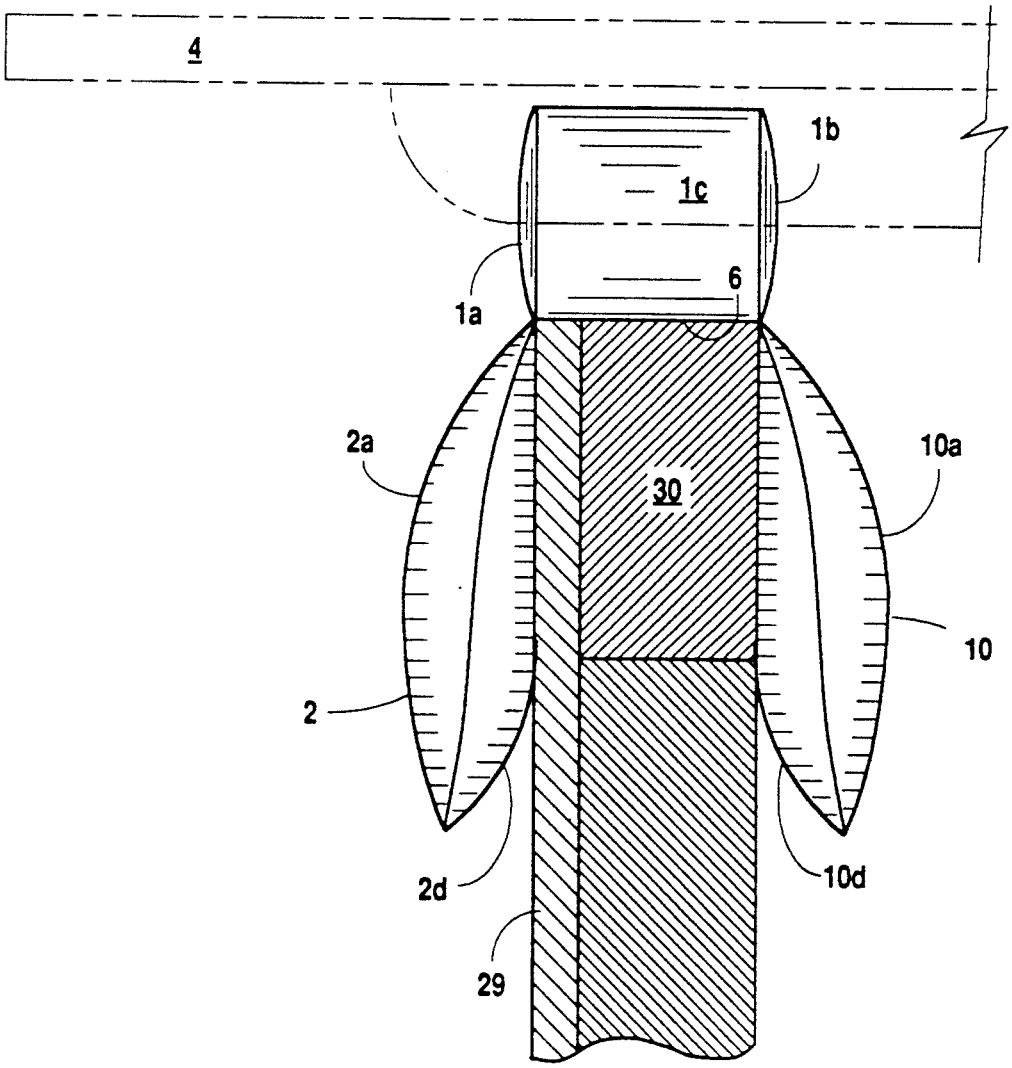
FIG. 6 is a side view of the invention shown positioned in the window of a deer blind with the deer blind shown in cross-section.

FIG. 6 shows the preferred embodiment from the side, draped over a cross-section of the typical construction of a deer blind. The bottom flat portion 6 of central compartment 1 is made approximately two and one-half inches in dimension from front to back, so that it will snugly fit the window jamb of a typical deer blind which consists of a 2×4 No. 30 faced with ⅜" siding 29. FIG. 6 also shows that front compartment 2 and rear compartment 10, because they are flexibly filled with sand, will conform to supporting members which are somewhat more thick than a typical deer blind or somewhat less thick. FIG. 6 also shows that bottom surface 2*d* of front compartment 2 and bottom surface 10*d* of rear compartment 10 will frictionally engage the wall of the deer blind or other support in order to further stabilize the gun mount.

The invention has been described in detail with particular reference to presently preferred embodiments, but it will be understood by one skilled in the art that variations and modifications can be effected within the spirit and scope of the invention.

What is claimed is:

1. A portable gun support apparatus, comprising:

a first, front compartment constructed from flexible material;

a second compartment constructed from flexible material and connected by a first hinge to the first compartment;

a third, rear compartment constructed from flexible material and connected by a second hinge, generally parallel to the first hinge, to the second compartment, with;

said second compartment having a top surface with a recess, said recess shaped so that a gun barrel rests in said recess generally perpendicular to said second compartment and to the first and second hinges of said second compartment; and each of said compartments having a releasable filling and closure means for filling said compartment with particulate matter of high density and retaining the particulate matter therein.

2. The apparatus of claim 1 in which the dimension from the first hinge to the second hinge along the bottom surface of the central compartment is in the range of one to three inches.

3. A portable gun support apparatus, comprising:

a first compartment constructed from flexible material;

a second compartment constructed from flexible material and hingedly connected to the first compartment;

a third compartment constructed from flexible material and hingedly connected to the second compartment;

said second compartment having a recessed portion for resting a gun barrel thereon; and each of said compartments having a releasable filling and closure means for filling said compartment with particulate matter of high density and retaining the particulate matter therein; and each of said compartments being sealed by a closure comprising a tab of hook material attached to the material which forms one surface of the compartment, and a second tab of loop material attached to the material which forms the second surface of the sand bag, in which the hook and loop tabs are internal to the sand bag and are fastened so as to form an internal spout.

* * * * *